United States Patent [19]

Quenzi

[11] 4,425,709

[45] Jan. 17, 1984

[54] POCKET TOOL

[76] Inventor: Phil Quenzi, Rte. 1 Box 56A, Atlantic Mine, Mich. 49905

[21] Appl. No.: 332,471

[22] Filed: Dec. 21, 1981

[51] Int. Cl.[3] ..... B26B 5/00

[52] U.S. Cl. ..... 30/151; 30/161

[58] Field of Search ..... 30/152, 160, 161, 156, 30/157, 339, 125, 337, 151; 145/62

[56] References Cited

U.S. PATENT DOCUMENTS

| | | | |
|---|---|---|---|
| 108,596 | 0/1870 | Hundley . | |
| 603,847 | 5/1898 | Harvey | 30/161 |
| 770,970 | 9/1904 | Keferstein | 30/161 X |
| 1,087,342 | 2/1914 | Yerzley | 30/157 |
| 1,413,954 | 4/1922 | Ball | 30/151 |
| 3,621,899 | 11/1971 | Hula | 146/43 R |
| 3,829,967 | 11/1972 | Gilbert | 30/157 |
| 3,845,554 | 4/1973 | Joanis et al. | 30/125 |
| 3,900,950 | 3/1974 | Collins | 30/337 |
| 4,011,657 | 11/1975 | Vance | 30/337 |
| 4,170,061 | 10/1979 | Henry | 30/160 |

*Primary Examiner*—Jimmy C. Peters

*Attorney, Agent, or Firm*—Trexler, Bushnell & Wolters, Ltd.

[57] ABSTRACT

A tool accommodating interchangeable tool blades comprises a handle for receiving one tool blade in a working position and at least one tool blade in a storage position. A first compartment is defined in the handle for receiving at least one tool blade in a storage position and includes a releasable locking arrangement for releasably locking one tool blade in a storage position. A second compartment is provided in the handle for receiving one tool blade in a working position and includes a second releasable locking arrangement for releasably locking the tool blade in the working position. The tool also includes at least one tool blade including a cooperating locking structure for releasably locking with either of the first or second releasable locking arrangements so as to releasably holding the tool blade assembled with the tool handle in either of the working position or storage position.

9 Claims, 5 Drawing Figures

POCKET TOOL

BACKGROUND OF THE INVENTION

The invention is directed generally to a pocket tool and more particularly to a pocket tool of the type having a handle adapted to interchangeably receive one of a plurality of tool blades in a working position and to receive one or more tool blades in a storage position.

Pocket tools such as pocket knives are well known in the art. It is also known to provide such pocket tools or pocket knives having a plurality of interchangeable blades for performing different tasks. Generally speaking, such tools have been theretofore provided in multiple blade "folding" configurations.

In the multiple blade "folding" configuration, a single handle carries a pluality of blades generally pivotally mounted thereon for movement from a storage compartment within the handle to a working position in generally colinear alignment with the handle. However, the pivotal mounting of the multiple blades in such a pocket knife generally requires a plurality of relatively expensive precision parts. Hence, such pocket tools are relatively expensive. Moreover, many such tools do not permit replacement of blades, for example, should one blade break or the user desire an additional, different tool blade. Some of the more expensive tools of this type do permit replacement of blades. However, a different or replacement blade or tool may be too large or otherwise not shaped to be accommodated by the storage compartments provided in the handle without removing another tool which the user wishes to retain in the handle. In either case, it will be recognized that the versatility of such a tool is limited and is often offset by its expense.

One may of course purchase a separate tool for each task to be performed, each being permanently attached to its own handle. However, the readily transportable or "pocket" nature of the "folding" tool described above is lost since plural tools must be then carried about with exposed blades.

The prior art has also proposed single handles capable of receiving any of a plurality of different tool blades. However, such devices have not heretofore provided simple yet effective storage means for carrying a plurality of such different blades when not in use and yet readily accessible and interchangeable when desired.

OBJECT AND SUMMARY OF THE INVENTION

Accordingly, it is an object of the present invention to provide a pocket tool for receiving a plurality of interchangeable blades which overcomes the problems of the prior art.

A more specific object is to provide such a pocket tool which provides storage for one or more interchangeable tool blades when not in use, yet holds the stored tool blades readily accessible for use when desired.

A related object is to provide a pocket tool in accordance with the foregoing objects wherein interchangeability of blades from a storage position to a working position is relatively simple.

A further object is to provide a pocket tool in accordance with the foregoing objects which is relatively simple and inexpensive and yet highly reliable in operation.

Briefly, and in accordance with the foreging objects, a pocket tool in accordance with the invention comprises a handle for receiving one tool blade in a working position and at least one tool blade in a storage position, a storage compartment in said handle including means for releasably locking at least one tool blade in a storage position, a working compartment in said handle including means for releasably locking one tool blade in a working position, and at least one tool blade including cooperating releasable locking means for interacting with either of the releasable locking means of the storage compartment or the working compartment of selectively assembling the blade with the handle in either of the working position or storage position.

BRIEF DESCRIPTION OF THE DRAWINGS

Other objects, features and advantages of the invention will become more readily apparent upon reading the following detailed description of the illustrated embodiment together with reference to the accompanying drawings wherein.

DETAILED DESCRIPTION OF THE ILLUSTRATED EMBODIMENT

Figures 1, 2, 3, 4, 5:
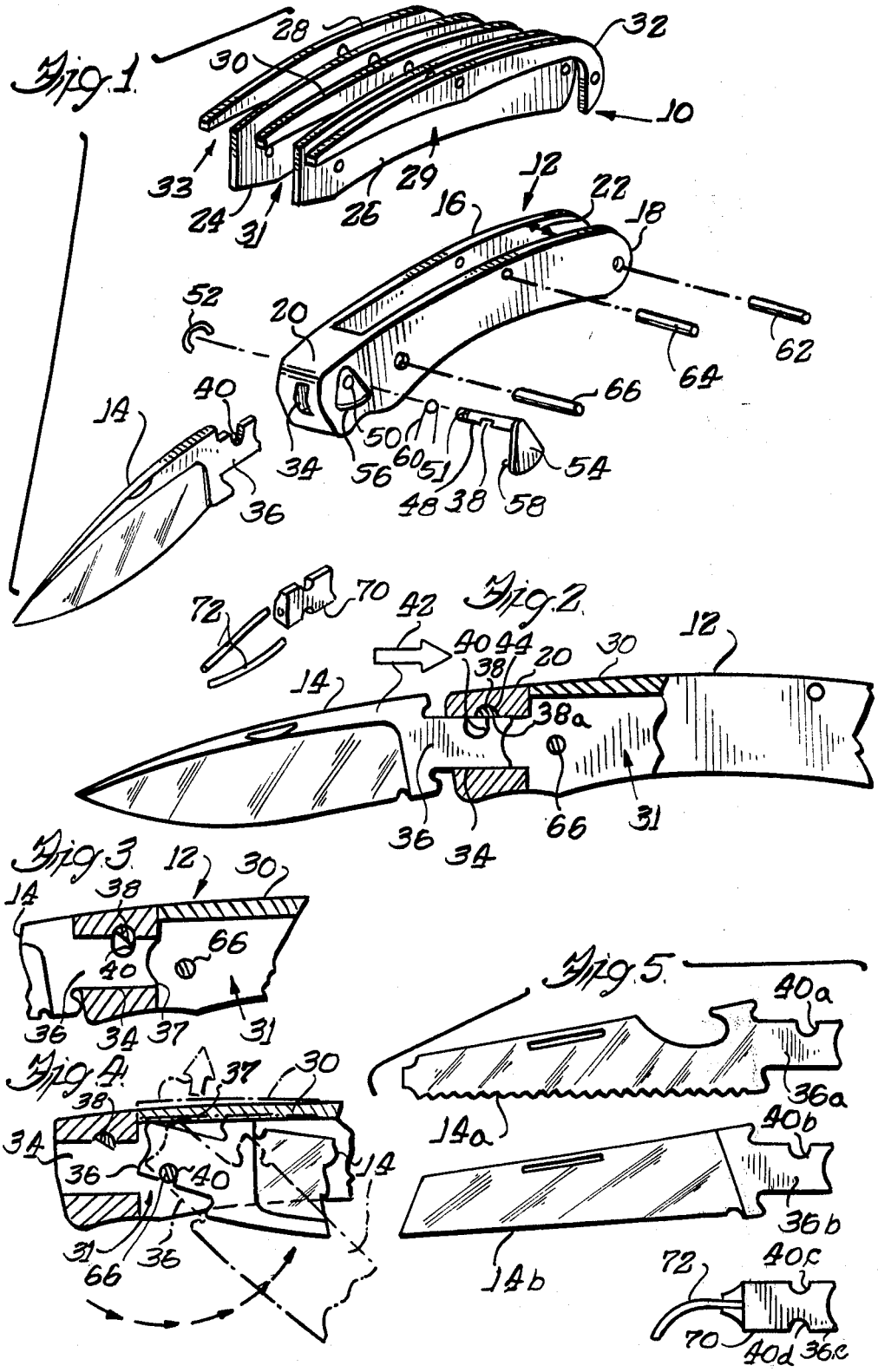
FIG. 1 is an exploded perspective view of a pocket tool in accordance with the invention.
FIG. 2 is a side elevation, partially broken away and partially in section illustrating one aspect of the operation of the pocket tool of the invention.
FIG. 3 is a side elevation, partially broken away and partially in section illustrating another aspect of operation of the pocket tool of the invention.
FIG. 4 is yet another side elevation, partially broken away and partially in section illustrating yet another aspect of the operation of the pocket tool of the invention.
FIG. 5 is a side elevation illustrating exemplary interchangeable tool blades useful with the pocket tool of the invention.

Referring now to the drawings and initially to FIG. 1, a pocket tool in accordance with the invention is designated generally by the reference numeral 10. In accordance with the invention, this tool 10 includes a tool handle 12 and at least one tool blade 14. The tool handle 12 is formed by a pair of similar side plates 16, 18 which are located in generally parallel and spaced apart condition by an integrally formed end portion 20. In the space 22 defined between the side plates 16 and 18, a plurality of tool storage compartments are formed by one or more additional similar, parallel and spaced apart elongate plates 24, 26.

In order to hold the respective plates 16, 18, 24 and 26 in parallel and spaced apart condition, a plurality of intermediate members 28, 30 and 32 are provided intermediate the respective plates 16, 18, 24 and 26. These intermediate members 28, 30 and 32 are configured to comform to the outer top and rear surfaces of the respective plates 16, 18, 24 and 26, and define respective open spaces or storage compartments 29, 31 and 33 between the respective plates, each for receiving a tool blade such as the blade 14.

In order to receive the blade 14 in a working position, the end portion 20 of the handle 12 is provided with a compartment or slot 34 extending interiorally thereof. As best viewed in FIG. 2, this compartment or slot 34 is generally rectangularly configured. Cooperatively, the blade 14 carries a dimensionally similar rectangularly configured tang 36 for interfitting with the slot 34.

In accordance with a feature of the invention, the slot 34 and blade 14 are provided with cooperating releasable locking means. In the illustrated embodiment, the releasable locking means take the form of a generally arcuate retractable stop member or tab 38 carried in one side wall of the slot 34 and a cooperating generally arcuate notch 40 in a corresponding side of the tool blade tang 36. Hence, with reference to FIG. 2, the tool blade 14 may be placed in a working position with respect to the handle 12 by initially aligning the tang 36 with the slot 34 and then moving the blade in the direction indicated generally by an arrow 42.

As will be seen later, the arcuate locking member or tab 38 is spring loaded to normally cause a portion thereof to intrude in the slot 34 as shown in FIG. 3. However, with reference to FIG. 2, it will be seen that as the tang 36 enters the slot 34, it engages the spring loaded retractable locking tab 38, causing retraction thereof into a correspondingly dimensioned aperture provided therefor in the interior wall of the handle end 20. Hence, a flat outer surface 38*a* of this locking tab 38 permits continued insertion of the tang 36 with respect to the slot 34 until the locking notch 40 comes to registry with the locking tab 38. Thereupon, and with reference again to FIG. 3, the spring loaded locking tab 38 resiliently returns to interengage a portion of the locking notch 40, thereby achieving a releasably locked condition between the slot 34 and tang 36, and hence between the handle 12 and blade 14.

Referring again to FIG. 1, the structure and operation of the locking tab 38 and associated components will now be described. In the illustrated embodiment, the locking tab 38 is formed from a generally cylindrical rod member 48 which is rotatably inserted through a cylindrical through aperture 50 in the end 20 of the handle 12. Preferably, the slot 34 and locking tab portion 38 of the rod 48 are substantially centrally located with respect to the width or thickness of the handle 12. Accordingly, the locking tab 38 is defined by a semicylindrical cut-out portion substantially centrally located along the axial length of the rod 48. An end portion of this rod 48 is preferably provided with a suitable groove 51 for receiving a generally circular retaining ring 52 for retaining the rod 48 in assembled, rotatable condition with the handle 12.

To rotate the rod 48 and hence locking member 38, the opposite extremity of the rod 48 is provided with a flat, generally triangularly shaped plate 54 permanently affixed thereto. Preferably a recess 58 of similar triangular shape to the plate 54 is provided aligned therewith in the handle portion 20. However, the plate 54 is held spaced generally above this recess 56 by the provision of an inwardly extending stop member 58 which protrudes from a lower edge of the plate 54 and at one side thereof.

A generally V-shaped compression or torsion spring 60 is carried within the recess 56 and rotatably mounted on the rod 48. Accordingly, one side or leg of the torsion spring 60 engages an inner sidewall of the recess 56 while the other side or leg thereof engages the protruding stop member 58 on the plate 54. The cut-out portion of the rod 48 forming the locking tab 38 is oriented with respect to the plate 54, spring 60 and stop 58 so as to be normally biased by the spring 60 into the position illustrated in FIG. 3. However, it will be recognized that movement of the plate 54 generally in the direction of the arrow 42 will result in compression of the spring 60 and corresponding rotatable movement of the rod 48 and hence the locking tab 38 to the position illustrated in FIG. 2 for accomplishing removal of the blade 14 from the handle 12. Also in this regard, insertion of the blade 14 in the direction 42 as indicated in FIG. 2 will engage the locking tab portion 38 of rod 48 to encourage similar movement of the plate 54 against the torsion spring 60 to permit insertion of the blade as already described with reference to FIG. 2.

The remaining plates 24 and 26 and intermediate members 28, 30 and 32 are held in assembled condition with the handle 12 by suitable pins 62, 64 and 66. The pins 62 and 64 are permanently affixed through respective coaligned through openings provided in the respective plates 16, 18, 24 and 26 and separator or divider members 28, 30 and 32. The latter pin 66 is similarly affixed through aligned openings in the respective plates 16, 18, 24 and 26. However, with reference to FIG. 4, it will be seen that this pin 66 is positioned away from the remaining separating members 28, 30 and 32.

Advantageously, the outermost ends of each of these members 28, 30 and 32 are elastically deformable in the fashion of a leaf spring, to some extent about the pin 64.

Moreover, the pin 66 is spaced apart from the outer ends of members 28, 30 and 32 a sufficient extent to allow engagement thereof with the locking slot 40 of the blade tang 36 to accomplish storage thereof within the respective compartments provided in the handle 12.

In this regard and referring still to FIG. 4, it will be seen that the pin 66 is spaced apart from the outer ends of the member 30 (and hence of members 28 and 32 as well) by an amount somewhat less than the dimension of the tang 36 from an innermost edge of the locking slot 40 to a remote corner 37 thereof. Accordingly, the elastically deformable nature of the outer edge of member 30 cooperates with the pin 66 and tang 36 in releasably locking the plate 14 in storage position within the handle 12. In this ragard, it will be seen that when the edge or corner 37 of the tang 36 is brought directly above the pin 66 (as illustrated in phantom line in FIG. 4) the outer end of the member 30 is elastically deformed upwardly somewhat (also shown in phantom line). It will be appreciated that further rotation of the blade 14 toward the position shown in full line in FIG. 4 will result in spring-like return action of the deformed member 30, which will in turn cause a fulcruming or fulcrum-like action of the blade 14 about pivot pin 66 and into the storage position illustrated in full line in FIG. 4. It will be further noted that the outer edge portion of the blade 14 remains extending somewhat outwardly of the handle 12 in the storage position so that gripping of this edge is facilitated for removal of the blade 14 from the storage position within the handle 12.

In this latter regard, removal is the opposite of insertion, requiring only that the edge 37 be brought somewhat to the right of the position illustrated in phantom line in FIG. 4, again similarly elastically deforming the outer end portion of the member 30. Thereupon, further rotation of the blade 14 about the pin 66 will result in the spring-like action of the deformed member 30 encouraging the movement of the blade 14 outwardly of the handle 12 to facilitate removal thereof.

From the foregoing, it will be seen that the provision of the pin 66 and elastically deformable mounting of the members 28, 30 and 32 permits as many as three blades to be similarly releasably lockingly stored within the handle 12 in the illustrated embodiment. Fewer or more such blades may be similarly provided with corresponding storage compartments without departing from the invention.

Moreover, the relatively simple configuration of the tang 36 with the locking notch 40 cooperates with both the locking member 38 and the rod 66 (and deformable portions of the members 28, 30, 32) to accomplish relatively simple mounting of the blade 14 in either the working or storage positions with respect to the handle 12. Hence, both the construction and operation of the tool 10 in accordance with the present invention is greatly simplified.

Referring briefly to FIG. 5, additional interchangeable tool blades 14*a*, 14*b* may readily be provided in the same fashion. It will be noted that each of these blades 14*a* and 14*b* includes a substantially similar tang portion 36*a*, 36*b* and a locking notch 40*a*, 40*b* for facilitating mounting in either of the working or storage positions with respect to the handle 12.

In accordance with one practical and preferred form of the invention and referring to both FIG. 1 and FIG. 5, a novel lanyard arrangement for carrying the pocket tool 10 is designated by the reference numeral 70. Briefly, this lanyard 70 comprises a tang member 36*c* which is substantially similarly configured to the tang member of each of the blades 14, 14*a*, 14*b* heretofore described. However, this latter tang 36*c* preferably includes a pair of symmetrically located locking slots 40*c*, 40*d* so that it may readily be inserted in either orientation with respect to the slot 34. A suitable carrying device such as an elongate cord 72 is preferably permanently affixed to an outer end of the tang 36*c* to thereby form a convenient lanyard useful for carrying the pocket tool 10. Hence, the cord 72 may be conveniently affixed to an article of clothing of the user, whereby the tang 36*c* thereof may be readily inserted in the slot 34 of the handle 12 when no tool is in the working position, to facilitate ready transport of the pocket tool 10.

While the invention has been described herein with reference to a preferred embodiment, the invention is not limited thereto. Those skilled in the art may devise various changes, alternatives and modifications upon reading the foregoing descriptions. The invention includes such alternatives, changes and modifications insofar as they fall within the spirit and scope of the appended claims.

The invention is claimed as follows:

1. A tool accommodating removable and interchangeable tool blades comprising: a handle capable of simultaneously receiving one tool blade in a working position and at least one tool blade in a storage position, a first compartment defined in said handle for receiving said at least one tool blade in a storage position and including releasable locking means for removably and releasably locking said at least one tool blade in a storage position, a second compartment in said handle for receiving said one tool blade in a working position and including second releasable locking means for removably and releasably locking said tool blade in said working position, and at least one tool blade including cooperating locking means for removably and releasably locking with either of the first or second releasable locking means for releasably holding the tool blade removably assembled with the tool handle in either of the working position or storage position; wherein said second compartment comprises a slot; wherein said at least one tool blade comprises a working portion and a tang dimensioned to removably, slidably interfit with said slot; wherein said slot and said tang are substantially rectangular, and wherein said cooperating locking means comprises a notch formed in one side of said rectangular tang and said second releasable locking means comprises a rectractable stop member in one side of said slot for releasably locking with said notch when said tang is positioned so as to place said notch in registry with said retractable stop member; wherein said retractable stop member comprises an arcuate member and wherein said notch is arcuately shaped for receiving at least a portion of said arcuate retractable stop member.

2. A tool according to claim 1 wherein said retractable stop member is spring-loaded for normally entering said notch when said notch is placed in registry therewith and further including release means mounted on said handle and operatively coupled with said retractable stop member for selectively releasing said retractable stop member from said notch.

3. A tool according to claim 2 wherein said spring-loaded stop member is arranged for elastically yielding to said tang during insertion thereof into said slot until said notch is in registry with said stop member.

4. A tool according to claim 1 or claim 3 and further including pin means in said storage compartment located for removably pivotally receiving said notch, whereby said blade is rotatable about the pivotally engaged notch and pin means to a storage position substantially within said compartment, and wherein said first releasable locking means includes elastically deformable means mounted in said storage compartment.

5. A tool according to claim 4 wherein said elastically deformable means comprises a leaf spring spaced apart from said pin means for engaging a leading edge portion of said tool blade tang for fulcruming said tool blade about said pivotally engaged notch and pin for insertion into and removal from said storage compartment, respectively.

6. A tool according to claim 1 and further including lanyard means comprising a tang portion dimensioned similarly to said at least one tool blade tang portion for releasable locking engagement with said second compartment and carrying cord means coupled with said lanyard tang.

7. A tool according to claim 1 wherein three tool blades are provided, each having substantially identical cooperating locking means, and wherein three storage compartments are provided in said handle for receiving each of said three tool blades.

8. A tool accommodating interchangeable tool blades comprising: a handle for receiving one tool blade in a working position and at least one tool blade in a storage position, a first compartment defined in said handle for receiving said at least one tool blade in a storage position and including releasable locking means for releasably locking said at least one tool blade in a storage position; a second compartment in said handle for receiving said one tool blade in a working position and including second releasable locking means for releasably locking said tool blade in said working position; at least one tool blade including cooperating locking means for releasably locking with either of the first or second releasable locking means for releasably holding the tool blade assembled with the tool handle in either of the working position or storage position; and lanyard means comprising a tang portion dimensioned similarly to said at least one tool blade tang portion for releasable locking engagement with said second compartment and carrying cord means coupled with said tang portion.

9. A tool accomodating removable and interchangeable tool blades comprising: a handle capable of simultaneously receiving one tool blade in a working position and at least one tool blade in a storage position, a first compartment defined in said handle for receiving said at least one tool blade in a storage position and including releasable locking means for removably and releasably locking said at least one tool blade in a storage position, a second compartment in said handle for receiving said one tool blade in a working position and including second releasable locking means for removably and releasably locking said tool blade in said working position, and at least one tool blade including cooperating locking means for removably and releasably locking with either of the first or second releasable locking means for releasably holding the tool blade removably assembled with the tool handle in either of the working position or storage position; wherein said second compartment comprises a slot; wherein said at least one tool blade comprises a working portion and a tang dimensioned to removably, slidably interfit with said slot; wherein said slot and said tang are substantially rectangular; wherein said cooperating locking means comprises a notch formed in one side of said rectangular tang and said releasable locking means comprises a retractable stop member in one side of said slot for releasably locking with said notch when said tang is positioned so as to place said notch in registry with said retractable stop member; and further including pin means in said storage compartment located for removably pivotally receiving said notch, whereby said blade is rotatable about the pivotally engaged notch and pin means to a storage position substantially within said compartment, and wherein said first releasable locking means includes elastically deformable means mounted in said storage compartment.

* * * * *